US007130178B2

(12) United States Patent
Pletcher et al.

(10) Patent No.: US 7,130,178 B2
(45) Date of Patent: Oct. 31, 2006

(54) CORONA CHARGING DEVICE AND METHODS

(75) Inventors: Timothy Allen Pletcher, Easthampton, NJ (US); David Keller, Newtown, PA (US); Wen Ho, Plainsboro, NJ (US); Eugene Samuel Poliniak, Willingboro, NJ (US); John Paul Furda, Hamilton, NJ (US); John Thomas McGinn, Flemington, NJ (US); Donald Chester Pultorak, Trenton, NJ (US); Mortaza Kashef, Trenton, NJ (US)

(73) Assignee: Sarnoff Corporation, Princeton, NJ (US)

( * ) Notice: Subject to any disclaimer, the term of this patent is extended or adjusted under 35 U.S.C. 154(b) by 335 days.

(21) Appl. No.: 10/386,252

(22) Filed: Mar. 11, 2003

(65) Prior Publication Data

US 2004/0179322 A1 Sep. 16, 2004

(51) Int. Cl.
*H01T 23/00* (2006.01)

(52) U.S. Cl. ..... 361/226; 361/230

(58) Field of Classification Search ..... 361/225, 361/212, 230, 226

See application file for complete search history.

(56) References Cited

U.S. PATENT DOCUMENTS 4,351,603 A 9/1982 Tagawa ..... 399/148
4,837,658 A * 6/1989 Reale ..... 361/230
6,319,541 B1 * 11/2001 Pletcher et al. ..... 427/2.14

* cited by examiner

*Primary Examiner*—Stephen W. Jackson
(74) *Attorney, Agent, or Firm*—William J. Burke

(57) ABSTRACT

The invention is directed to a corona charging device having a powder feed with an outlet. The device has an internal charging cavity having an inlet and a charged powder outlet. The powder feed outlet is positioned at the internal charging cavity inlet. The device is adapted to guide a powder stream downstream from the powder feed outlet to the charged powder outlet. The device also includes a corona charger having one or more needle projections (each having a tip) positioned and adapted to facilitate a corona ion flow from the needle projections and intersecting the powder stream. The device also includes a rotating ground electrode adapted to be charged or grounded to attract the corona flow from the needle projections, and to rotate segments of the ground electrode between the internal charging cavity and a ground electrode cleaner.

41 Claims, 12 Drawing Sheets

CORONA CHARGING DEVICE AND METHODS

The present invention relates to devices for charging powders, and methods of charging powders.

Applicant has developed dry powder deposition systems for depositing and metering dry, pharmaceutical powders onto substrates. These systems are based upon the use of electric field to levitate charged powder particles from the entrance of a deposition chamber to a target substrate. Various copier and printing devices use charged powders (termed in this context toners), to electrostatically form images. A number of industrial spray painting devices apply charged powder, which is typically fused after spraying by the application of a heat or a solvent mist. All of these applications require efficient, robust devices for reproducibly applying charge to the respective powders.

In the pharmaceutical example, charged particles may be focused onto a substrate using the electric field formed using a deposition electrode sometimes in combination with a focusing electrode. See for example U.S. Pat. No. 6,370,005. Powders may be charged by any suitable technique, including triboelectric charging and corona charging, but useful charge densities over a variety of materials have been found to be reliably achieved with corona charging.

For conventional charging devices, surfaces in the charging zone accumulate powder over time, leading to charge uniformity degradation, corona discharge and other undesirable phenomenon. For example, as the charged powder particles accumulate on a ground electrode, undue charge accumulation may take place when the accumulated powder layer exceeds a monolayer. Such charge accumulation can result in corona discharge. Such corona discharges cause free ions of the opposite polarity of the charged powder to flow across the charging zone toward the corona electrodes. The oppositely charged ions also attach themselves to the powder crossing the charging zone and lower the net charge on the powder exiting the charging device. This effect can be so severe that the powder exiting the charging device may retain a net neutral charge. The present invention provides a number of features to minimize such disruptive powder buildup and charge accumulation.

Another issue addressed by the invention is the need to expose the powder to a uniform electric field in the charging zone to increase the uniformity of powder charging. Electric field uniformity in the charging zone promotes consistent powder charging and a stable charge to mass ratio of the powder leaving the outlet of the charging device.

A potential safety issue, and an issue in controlling the gas source and volume entrained with the powder, is how well the corona charging device is sealed against unwanted gas flows; this issue is also addressed by the invention.

The invention further addresses the issue of minimizing the free ion current that leaves the outlet of the charging device. Free ion current at the deposition site in the system is a noise source that varies the estimation of mass deposition. For industrial spraying systems, free ion current limits the mass deposition onto a part and can affect the quality of the surface finish produced by the powder coating.

SUMMARY OF THE INVENTION

One aspect of the invention relates to a corona charging device having a powder feed (such as a tube or other feed device) with an outlet. The device has an internal charging cavity into which the powder feed outlet delivers powder, and has a charged powder outlet. The device is adapted to guide a powder stream from the powder feed outlet to the charged powder outlet. The device also includes a corona charger having one or more needle projections (each having a tip) positioned and adapted to facilitate a corona ion flow from the needle projections and intersecting the powder stream.

The device also includes a rotating electrode (also referred to as a rotating ground electrode), adapted to be charged or grounded; to induce the corona flow from the needle projections. The term "ground electrode" as it is used herein refers to an electrode having an electrical bias for attracting free ions, but does not imply that the electrode must be biased or coupled to ground potential. Indeed the ground electrode can be charged or grounded and essentially provides a surface to capture free ions. A rotating ground electrode has portions or segments that are moved into and out of the internal charging cavity (and optionally into an electrode cleaner). In another aspect of the invention, the rotating electrode is drum-shaped.

In another aspect of the invention, the device includes two or more needle projections located at different distances from the charged powder outlet, and wherein the amount that the needle projections project into the charging cavity varies so that the distance from tip of the needle projections to the rotating electrode is more even.

In yet another aspect of the invention, the rotating electrode is a belt or metalized tape, with the segment of the rotating electrode adjacent to the corona charger being substantially flat. Optionally, the rotating electrode is disk shaped.

In another aspect of the invention, the cleaner is one or more scrapers for scraping powder off the rotating electrode. Optionally, the cleaner can include two or more scrapers for scrapping powder off the rotating electrode, the scrapers positioned serially such that each successive scraper encounters a segment of rotating electrode cleaned by an earlier scraper.

In another aspect of the invention, the cleaner includes a liquid feed that outputs liquid to a sponge, wherein the sponge is positioned to contact the rotating electrode; and one or more scrapers for scrapping the liquid and any powder entrained in the liquid off the rotating electrode.

In another aspect of the invention, an additional electrode is located downstream of the corona charger and positioned and adapted to induce free ion charges entrained in the powder stream to contact the ground electrode. The device can include a controller adapted to accept a signal indicative of the amount of current collected at a target or deposition site to which the corona charging device output is directed, and to use such signal to determine if the device should be shut down, moved to a new deposition site, or a new deposition site moved to accept output from the corona charging device.

Another aspect of the invention relates to a method of corona charging a powder including the steps of: forming a corona field between the tips of one or more needle projections and a rotatable ground electrode having two or more segments; passing the powder through the corona field to charge the powder; rotating at least one segment of the ground electrode to a cleaning station while providing another segment aligned to form the corona; and cleaning the ground electrode segment rotating through the cleaning station.

In another aspect of the invention, the device has a powder feed having an outlet; an internal charging cavity having an inlet and a charged powder outlet, the powder feed outlet being positioned at the internal charging cavity inlet, the device being adapted to guide a powder stream downstream from the powder feed outlet to the charged powder outlet; a corona charger comprising one or more needle projections, each needle projection having a tip positioned and adapted to facilitate a corona ion flow from the needle projections and intersecting the powder stream; a ground electrode adapted to be charged or grounded to induce the corona flow from the needle projections; and a field electrode located downstream of the corona charger and positioned and adapted to induce free charges entrained in the powder stream to contact the ground electrode or a second ground electrode.

In another aspect of the invention, the device includes one or more needle projections (each having a tip) positioned and adapted to facilitate a corona ion flow from the needle projections and intersecting the powder stream; a ground electrode adapted to be charged or grounded to induce the corona flow from the needle projections; and a field electrode located downstream of the corona charger and positioned and adapted to induce free charges entrained in the powder stream to contact the ground electrode or a second ground electrode.

In another aspect of the invention, the device includes one or more power supplies operable to produce voltage and current in the charging zone; at least one feedback control circuit monitoring the ground electrode to maintain a precise current to the one or more needles by varying the power supply voltage; and an individual ballasting resistor on each needle so that all the needles will produce corona ion flow.

Another aspect of the invention relates to a method of corona charging a powder including the steps of forming a corona field between the tips of one or more needle projections and a ground electrode; passing the powder through the corona field to charge the powder and along a further processing pathway; and applying a second field to the powder in the processing pathway to induce free ions entrained with the powder to contact the ground electrode or a second ground electrode, the second field effective to reduce the free ions in the powder produced by the method by at least 1000 fold as compared to operating the method without the second field.

In another aspect of the invention, the second field is effective, when the powder stream is applied to a deposition site, to reduce currents at the deposition site due to the free ions to 0.05% or less (preferably 0.01% or less) of currents at the deposition site due to charged powder.

In another aspect of the invention, the device includes a powder feed having an outlet; an internal charging cavity having an inlet and a charged powder outlet, the powder feed outlet being positioned at the internal charging cavity inlet, the device being adapted to guide a powder stream downstream from the powder feed outlet to the charged powder outlet; a corona charger comprising one or more needle projections, each needle projection each having a tip positioned and adapted to facilitate a corona ion flow from the needle projections and intersecting the powder stream; a ground electrode adapted to be charged or grounded to induce the corona flow from the needle projections; and one or more sheath conduits positioned around the powder feed to provide (i) a sheathing gas stream between the powder stream and the points of the needle projections and (ii) a sheathing gas stream between the powder stream and the ground electrode.

In another aspect of the invention, the device includes a nozzle fitting attached to or incorporated into the powder feed outlet having a greater width than the powder feed the nozzle fitting is also adapted to narrow one or more of the sheath conduits to allow a smaller gas flow (in volume per meter per time at operating temperature) to match the flow speed of the powder stream and separate the corresponding sheathing gas stream from the powder stream.

In another aspect of the invention, the device includes a manifold formed upstream of the nozzle fitting for collecting gas to be distributed through the sheath conduits.

In another aspect of the invention the nozzle has a nozzle outlet adapted to narrow the flow of powder in the dimension parallel to the corona current, and to broaden the flow of powder in the plane orthogonal to that dimension.

Another aspect of the invention is directed to a method of corona charging a powder including the steps of forming a corona field between the tips of one or more needle projections and a ground electrode; passing a stream the powder through the corona field to charge the powder and along a further processing pathway; and concurrently passing a stream of gas having approximately the same velocity as the powder stream between the powder stream and the needle projections or the ground electrode.

In another aspect of the invention, the device includes a powder feed having an outlet; an internal charging cavity having an inlet and a charged powder outlet, the powder feed outlet being positioned at the internal charging cavity inlet, the device being adapted to guide a powder stream downstream from the powder feed outlet to the charged powder outlet; a corona charger comprised of a staggered array of three or more needle projections (each having a tip) positioned and adapted to facilitate a corona ion flow from the needle projections and intersecting the powder stream; and a ground electrode adapted to be charged or grounded to induce the corona flow from the needle projections.

In another aspect of the invention, the device includes one or more power supplies operable to produce voltage and current in the charging zone; a feedback control circuit monitoring the ground electrode to maintain a precise current to the one or more needles by varying the power supply voltage; and an individual ballasting resistor on each needle so that all the needles will produce corona ion flow.

Another aspect of the invention is directed to a method of corona charging a powder including the steps of: forming a corona field between the tips of a staggered array of needle projections and a ground electrode; and passing the powder through the corona field to charge the powder.

In another aspect of the invention, the device includes a powder feed having an outlet; an internal charging cavity having an inlet and a charged powder outlet, the powder feed outlet being positioned at the internal charging cavity inlet, the device being adapted to guide a powder stream downstream from the powder feed outlet to the charged powder outlet; a corona charger comprising one or more needle projections, each of the needle projections having a portion that protrudes into the charging cavity positioned and adapted to facilitate a corona ion flow from the needle projections and intersecting the powder stream; a ground electrode adapted to be charged or grounded to induce the corona flow from the needle projections; one or more sheath ducts positioned around portions of one or more of the needle projections from an interior part of the device to the portion of the needle projections that protrudes into the charging cavity; a manifold connected to the sheath conduit(s) and positioned for directing gas through the sheath conduit(s); and a controllable source of gas pressure connected to the manifold.

In another aspect of the invention, the device includes forming a corona field between the tips of one or more needle projections (each having a portion including the respective tip that protrudes into a charging cavity) and a ground electrode; passing the powder through the corona field to charge the powder and along a further processing pathway; and for at least one needle projection, periodically passing a pulse of gas though a sheath around that needle projection and into the charging cavity, the pulse of gas effective to remove a portion of accumulated powder on the needle projection tip should such accumulated powder be present.

DETAILED DESCRIPTION OF THE INVENTION

Figure 1A:
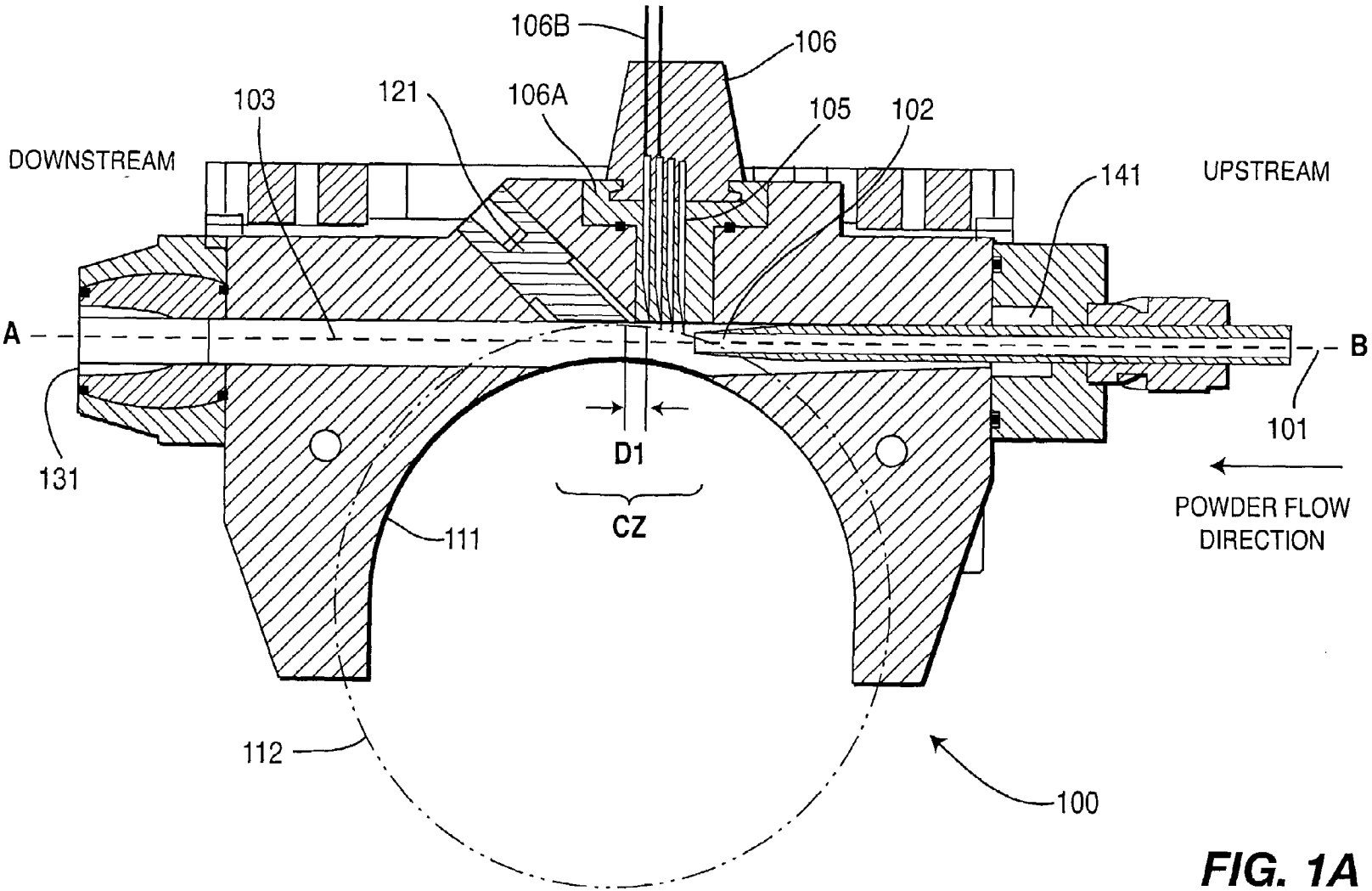
FIG. 1A displays a corona charging device that uses a drum for the ground electrode, with FIG. 1B showing an enlarged portion.

FIG. 1 illustrates in cross-section a corona charging device 100 in accordance with the invention. The device generally includes one or more needles located in a charging chamber 103, a ground electrode and a field electrode. The needles are energized by a power supply (not shown). In this illustrative embodiment, the powder feed 101 (in this case, a tube, which can be round, oval, square, rectangular, triangular, the foregoing with rounded corners, or any appropriate shape) has an outlet 102 positioned in the charging chamber inlet 104, located upstream (relative to powder flow) of the projecting ends of the needles 105 in the corona charging zone. The powder feed and charging chambers can have a variety of cross sectional profiles including but not limited to square, rectangular, round, oval or other simple or complex geometric shapes. The needles 105 are disposed in a needle holder 106A. A appropriate material 106 (such as potting compound material) is used to electrically insulate, and mechanically restrain, the connection between the needles 105 and wires 106B.

The upstream to downstream axis is shown as B-A, where A correlates to the downstream side and B correlates to the upstream side. The corona field axis is shown as C-D on FIG. 1B. The needle projections are positioned to provide a relatively uniform distance to the drum-shaped ground electrode that would be positioned in channel 111 (for the ground electrode drum, see FIG. 2). The diameter of channel 111 in this illustrative example is 3 inches. It is understood that other dimensions are possible without departing from the scope of the invention. Alignment boundary 112 is an imaginary circle with the same origin as the axis of rotation for the drum with a larger radius that defines the boundary against which the needle projections 105 are aligned. The field electrode 121 is positioned further downstream, with the distance D1 between the upstream edge of the field electrode 121 and the downstream needle projection 105 (from its center axis) providing a useful design feature. If D1 is too small, direct discharges between the needle projection 105 and the field electrode 121, facilitated by the powder, are more likely. At a 1000 V difference between the voltage applied to the needle projections and the field electrode 121, 0.100 inches is a sufficient value for D1 to prevent such arcing. It is understood that D1 can be varied depending on various conditions (e.g., applied voltage, powder characteristics). For example, a larger gap, such as 0.200" is desirable, to assure the lack of arcing when a sticky, conductive powder is being charged. A charging zone CZ is formed by the corona needles 105 (energized by the power supply), the field electrode if present, the complementary portions of the ground electrode, and the walls of the charging chamber in this region.

A potential is applied to the field electrode 121 that has the same polarity as that applied to the needle projections 105, and a value adapted, in view of the length of the field electrode 121 along the B-A axis, to induce ions entrained in the powder stream to contact the ground electrode. Given the higher mobility of the ions versus the powder, the voltage is also adapted so as to minimize the deflection of the powder to the ground electrode and prevent the disruption of its fluid flow along the B-A axis.

In this embodiment, the cross-section of the charging chamber 103 is transitioned to a circular profile with nozzle 131. Manifold 141 provides gas to flow through sheath conduits 142 and 143 (seen in FIG. 1B). In this embodiment, these conduits are contiguous and connected around the powder feed as an annulus, thereby sheathing the entire powder feed 101, but the conduits are here illustrated as separate items to illustrate the importance of gas steams that shepherd powder away from the operating electrodes. Since powder buildups anywhere are undesirable, lateral sheath conduits (not shown), are of course also useful. Gas flowing through sheath conduits 142 and 143, in conjunction with the gas flow that entrains the powder, provides a flowing barrier to powder accumulation on the sides of the charging chamber 103. In the illustrated embodiment, the manifold 141 receives gas from feeds coming in from above and below the illustrated cross-section (these are not shown).

Figure 1B:
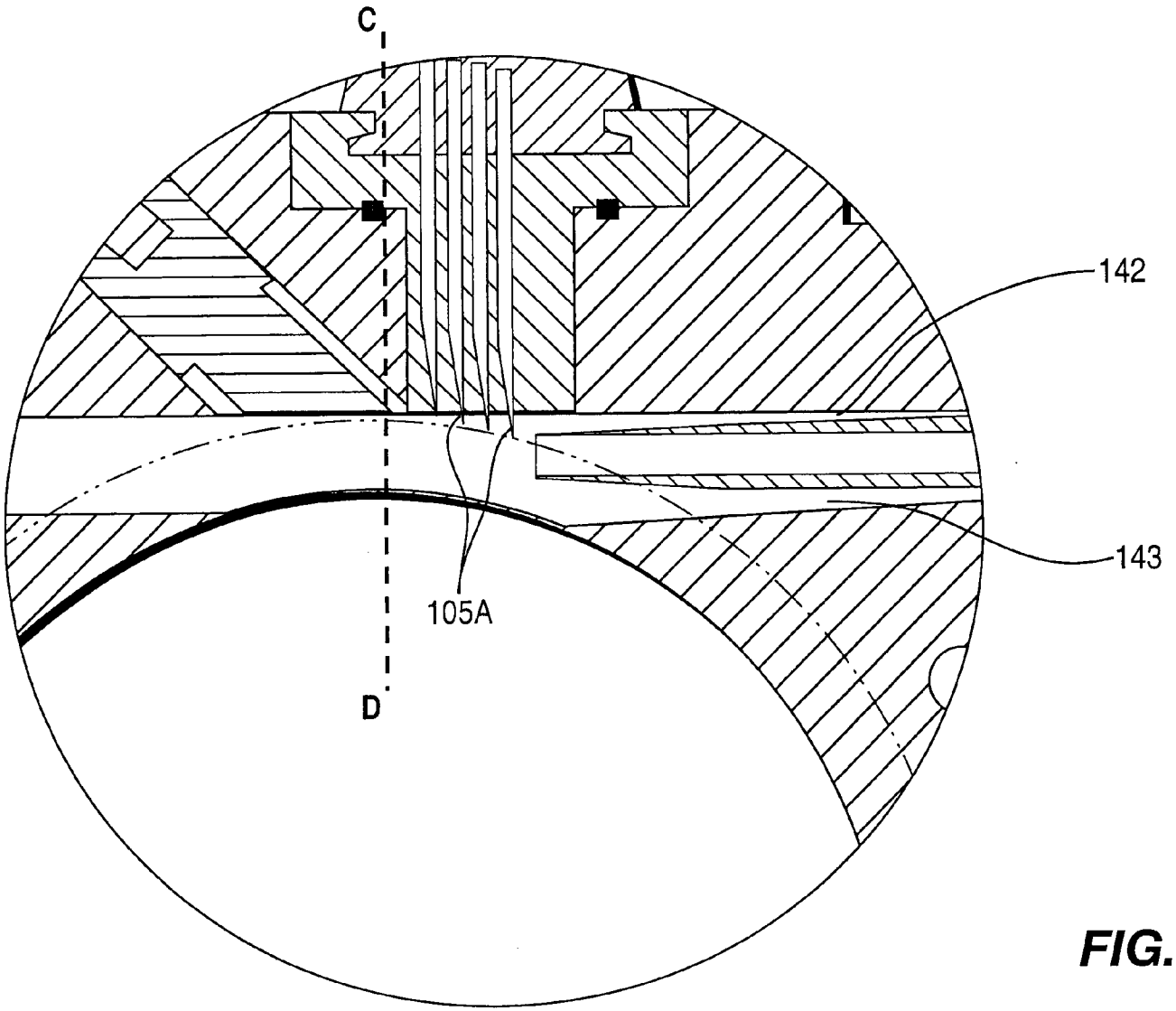

As can be seen in FIG. 1B, the needle projections 105 have portions 105A that protrude into the charging chamber. The distance of such protrusion is preferably selected as to allow the charge applied to the needle projections to be concentrated at the tips of the needle projections without diffusing to the surface of the dielectric in which the needle projections are embedded, while not being so long as to unduly contribute to vortexes in the gas flow about the needle projections. Using other embodiments of the invention than that here illustrated, in which other embodiments the protrusion distance is even, this adjustment can be more optimally made.

The ion source used by the illustrated device is a matrix of needle projections (e.g., stainless steel, tungsten or other appropriate material) located across form the ground electrode. A high voltage is applied to the needle projection matrix and forms a strong electric field between the needle projection tips and the ground electrode. The electric field at the needle projection tips can be made sufficient to cause a corona to form at the tips of each of the needle projections. The ability to produce corona from a matrix of needles is made possible by electrically ballasting each needle with a high impedance resistor. For negative corona, free ions of one polarity within the corona are then accelerated by the electric field to the ground electrode while the opposite polarity ions within the corona are accelerated to the needle projection tips. Positive corona works slightly differently, see e.g., JA Cross, "Electrostatics, Principles, Problems and Applications", 1987, IOP Publishing Limited, page 48. When powder is passed through the flux of unipolar ions formed between the needle projections (ion source) and the ground electrode, the powder will become charged by ion attachment at the powder surface.

The mobility of the free ions is very high. Most free ions in the charging zone are guided to the ground electrode by the electric field between the tips of the needle projections and the ground electrode. However, laboratory experiments with corona charging devices coupled to the remainder of a charged powder deposition system have proved that some free ions have escaped such charging devices. The number of escaping free ions was too high (e.g. ~40 nA for a 50 uA charging current and 400 nA of powder signal) for certain uses. This number represented approximately 10%–20% of the total powder current exiting the charging device. These free ions interfere in measuring deposition using accumulated charge as a surrogate indicator and have deleterious effects on the effectiveness and uniformity of deposition processes. For example, the edges of deposition substrates may accumulate charge from these free ions, leading to uneven depositions and corona discharges. Also, if one seeks to coat the inside of a conductive vessel, the free ions will accumulate at the entry edge of the vessel due to the electric field lines terminating there. This will cause a corona discharge event to occur when powder begins to collect at the vessel edge. The corona discharge event will subsequently release free ions of polarity opposite that of the polarity of the charged powder into the air. These free ions will then attach to the oppositely charged powder and either partially or fully discharge the powder particles.

The thickness of a powder coating applied by conventional electrostatic guns is limited due to back corona that occur at the surface where the sprayed material is applied. A conventional electrostatic gun sprays both ionized air and charged powder accumulate at a surface. When the thickness of the charged powder coating exceeds a single powder particle layer, the ionized air molecules then attach to the existing powder deposition and charge the powder to a higher level. The additional charging causes the powder layer to discharge, resulting in an ion current following the electric field back to the electrostatic gun. This ion current has a polarity opposite to that of the powder and discharges incoming powder particles prior to arrival at the surface. These neutralized powder particles are not typically deposited onto the surface and remain uselessly airborne.

Applicants recognized that the electrode they term the "field electrode" could solve the problem of entrained ions. The field electrode is operated with an applied polarity of the order of magnitude as that applied to the needle projections, and of the same polarity. The length of this field electrode (along the B-A axis) is determined such that the highly mobile free ions have a predicted field-induced mobility sufficient to transit the C-D axis of the charging chamber prior to being pushed past the ground electrode by gas flow. The field trapping electrode is biased to a voltage close in value to that applied to the needle projection tips. The addition of this electrode lowers the free ion current escaping the charger to less than 30 pA from 40 nA with the same 50 uA charging current and improves the signal-to-noise by a factor of 1000.

By reducing free ions, the possibility of back corona is limited to situations where many powder particle layers have been deposited. A typical deposition density of deposited powder paints using the apparatuses and methods of the invention is 109 mg/sq. in. The back corona effect can also result in pitting of the powder surface. When powder is applied with no back corona effects, as can be more reproducibly accomplished with the invention, no pitting at the surface is evident. Moreover, the charging devices and techniques of the invention allow for powder coatings with stronger adhesion forces. A typical charge to mass ratio for powder with a conventional electrostatic spraying system is 0.5 nc/mg. With the invention, one can achieve charge to mass ratios of 4 nc/mg using the same powder. This charge density results thus in an adhesive force that is eight times stronger.

Powder that is highly charged also produces a cloud with greater space charge. This space charge is what drives the powder towards the deposition site and represents the force that overcomes the aerodynamic forces that can carry the powder away from the deposition site and into the exhaust. Therefore, higher charge to mass ratio powder helps achieve greater transfer efficiencies.

The charging devices and techniques of the invention also allow the output of the device to be much closer to the deposition site. In typical spray painting corona guns, the gun must be several feet away from the deposition site to allow the ions to charge the powder at the exit of the gun. Since the charging device of this invention charges the powder internally, that is within the gun itself rather than upon exiting from the device, the powder is already charged upon exit and can therefore be placed much closer to the deposition site, as close as 1 inch in some cases. This proximity also increases transfer efficiency.

The non-electrode portions of the corona charging device that contact the flow pathway for powder are typically constructed of dielectric material, such as without limitation polycarbonate, acrylic, polyester, styrene, ceramics, glasses, and other dielectric materials, for example with conductivity along the order of $10^{15}$ ohm-cm.

Figure 2:
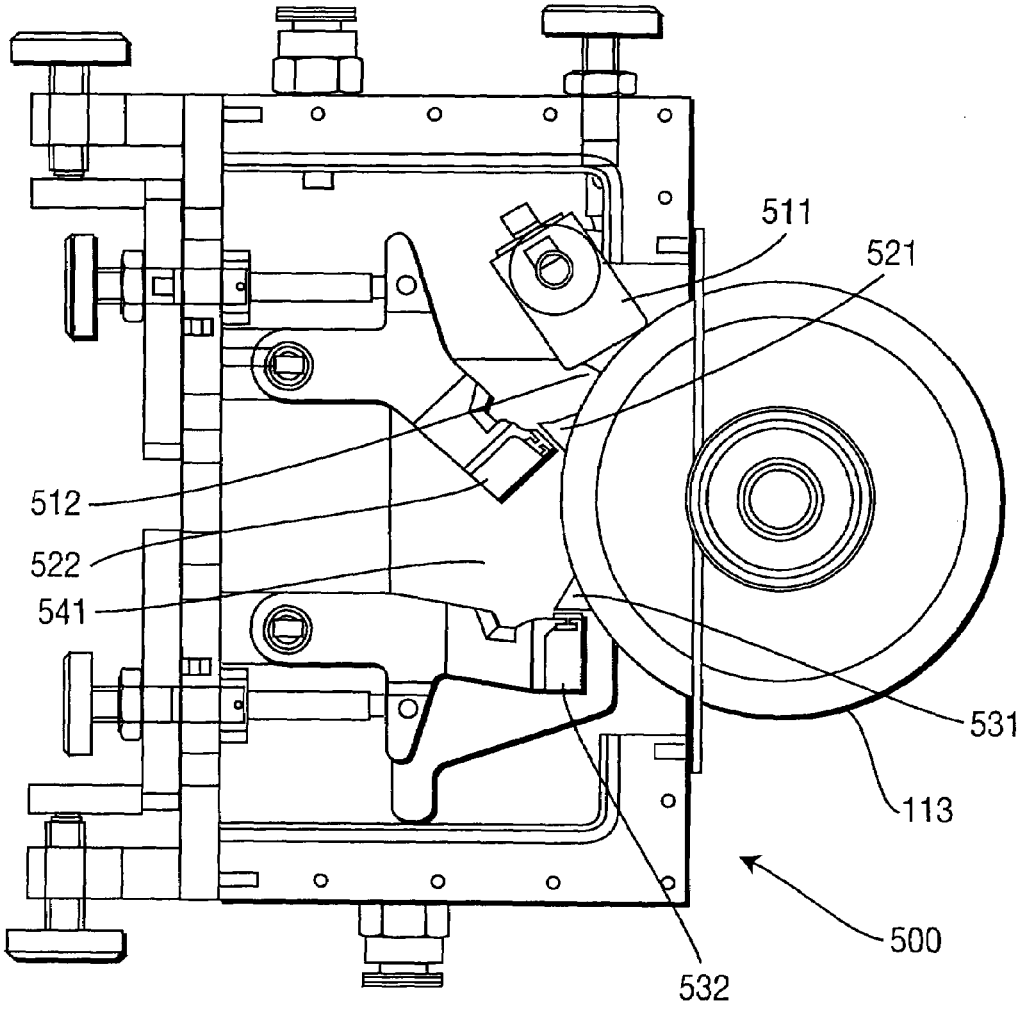
FIG. 2 shows an exemplary cleaning device that is operable in conjunction with the charging device of FIG. 1.

Solvent-based cleaner 500 illustrated in FIG. 2 can be fitted to the open side of channel 111, with the drum shaped ground electrode 113 fitting into the channel 111. The solvent reservoir is coupled in fluid communication with a sponge 512. The sponge is preferably seated in bracket (not shown) which can be adjusted for proper contact with the ground electrode. Wiper blades 521 and 531 are seated in wiper brackets 522 and 532, respectively, and are nearly tangent to the surface of the ground electrode. The wiper blades 521 and 531 are also preferably adjustable for proper contact with the ground electrode. The cleaner as illustratively configured is fitted to the corona charger in the illustrated orientation. The wiper blades 521 and 531 direct liquid wiped from the drum outward (to the left) and is directed to catch basin 541. In the illustration, they are nearly tangent to the drum surface. The solvent used is selected for its ability to either dissolve the powder or loosen the powder such that it is entrained with the solvent at the wiper stage.

Blades that can be used in the solvent-based cleaner include segments of automobile wiper blades. Other materials and configurations will be available to those of skill in the art. The solvent applicator can be replaced with a spray or misting device, or the like.

The illustrated embodiment uses the sheath conduits to minimize back corona and the accumulation of charged powder on the charging chamber walls by confining the initial trajectories of the powder particles entering the charging chamber to the central portion of the charging chamber. This may be accomplished, for example, by using a tube-in-tube design, namely a separate powder feed disposed within the generally tube shaped charging chamber. Powder traveling within a tube is known to distribute itself uniformly across the tube cross section. The tube-in-tube design confines the powder particles to the central portion of the charging chamber. This helps to minimize particle wall interaction by forcing the particles to travel further in the B-A direction before contacting such walls.

The forces that accelerate the powder particles in the B-A direction are the air drag force and the electric field. (The electric field accelerates particles in the C-D direction.) The mixing of the air streams from the sheath conduits and the powder feed as they enter the charging chamber produces radial drag forces on the particles. The electric field forces are the result of the applied electric field needed for corona discharge of the needle projection tips, and the field electrode and the space charge of the powder once ions have attached. Turbulent effects of the mixing air streams are minimized by the operating conditions of the tube-in-tube design and the static pressure at which the charging chamber is operated. The velocity of the air or other gas that flows through the sheath conduits is matched to the velocity of the powder stream to minimize turbulence where the two gas flows mix. The powder feed can be mechanically beveled at the exit (for instance with an angle less than 7 degrees) to reduce turbulence.

The electrode termed a "ground electrode" in this disclosure is conveniently operated at a ground potential, but other potential are useful as will be recognized by those of skill.

The above illustrated device has been used to achieve the following operational parameters or features:

Variable feed rate—Powder throughput rate through the system: from 0.5 gram/minute to 50 gram/minute powder.

Charging Efficiency—A 99% or higher charging efficiency (i.e. percentage of unipolar charged particles compared to all those oppositely charged and neutral) of the powder exiting the in-line charger.

Powder Efficiency—The powder efficiency (i.e. percentage of powder exiting the in-line charger compared to that entering the charger): greater than 99%.

Ion leakage current—The leakage current exiting the charger due to free ions is less than 50 pA for the 0.5 gram/min. feed rate. For higher feed rates, the leakage current is less than 0.01% of the total powder current. For highly charged pharmaceutical powder, which has a smaller particle size than dry powder paint, and thus can have for example a q/m of −5.5 uC/g, at a feed rate of 8.5 g/min, the leakage current was measured at 14 pA, which was less than 0.002% of the total powder current.

Variable particle charging—The amount of charge that is collected by a particle is a function of the electric field and ion density in the charging zone. The charging zone ion density is controlled by the control circuit shown in FIG. 8 and FIG. 10. This control circuit can be used to vary the charge to mass ratio of powders. This control can be used to increase the deposition mass per unit area by lowering the charge to mass ratio of the powder.

Accommodation of a broad array of powders—powders formed from metals, inorganic dielectrics, organic dielectrics and organic conductors have been successfully charged with devices of the invention.

Figure 3A:
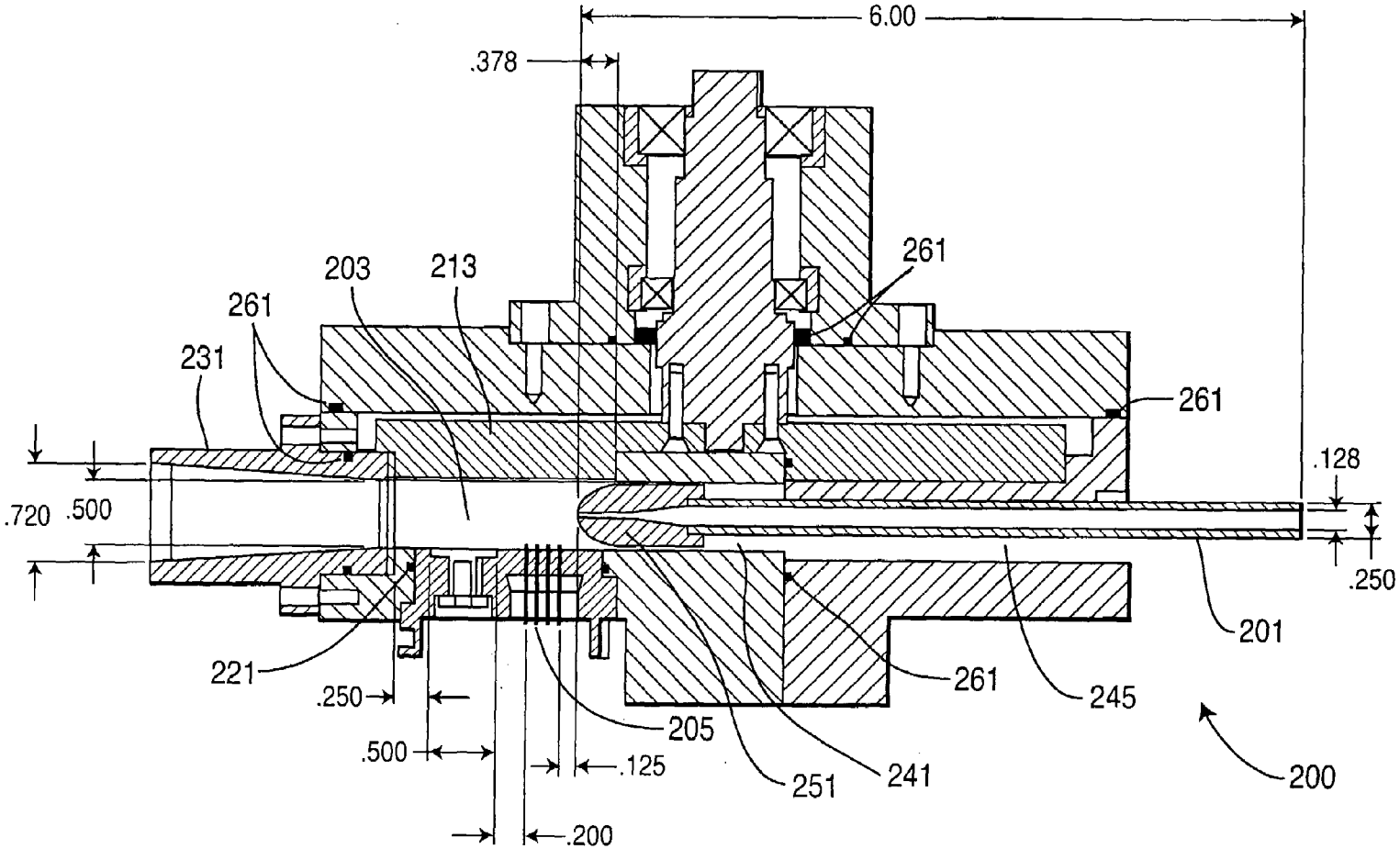
FIG. 3A shows a corona charging device in accordance with the invention, with FIG. 3B showing an enlarged portion.
Figure 3B:
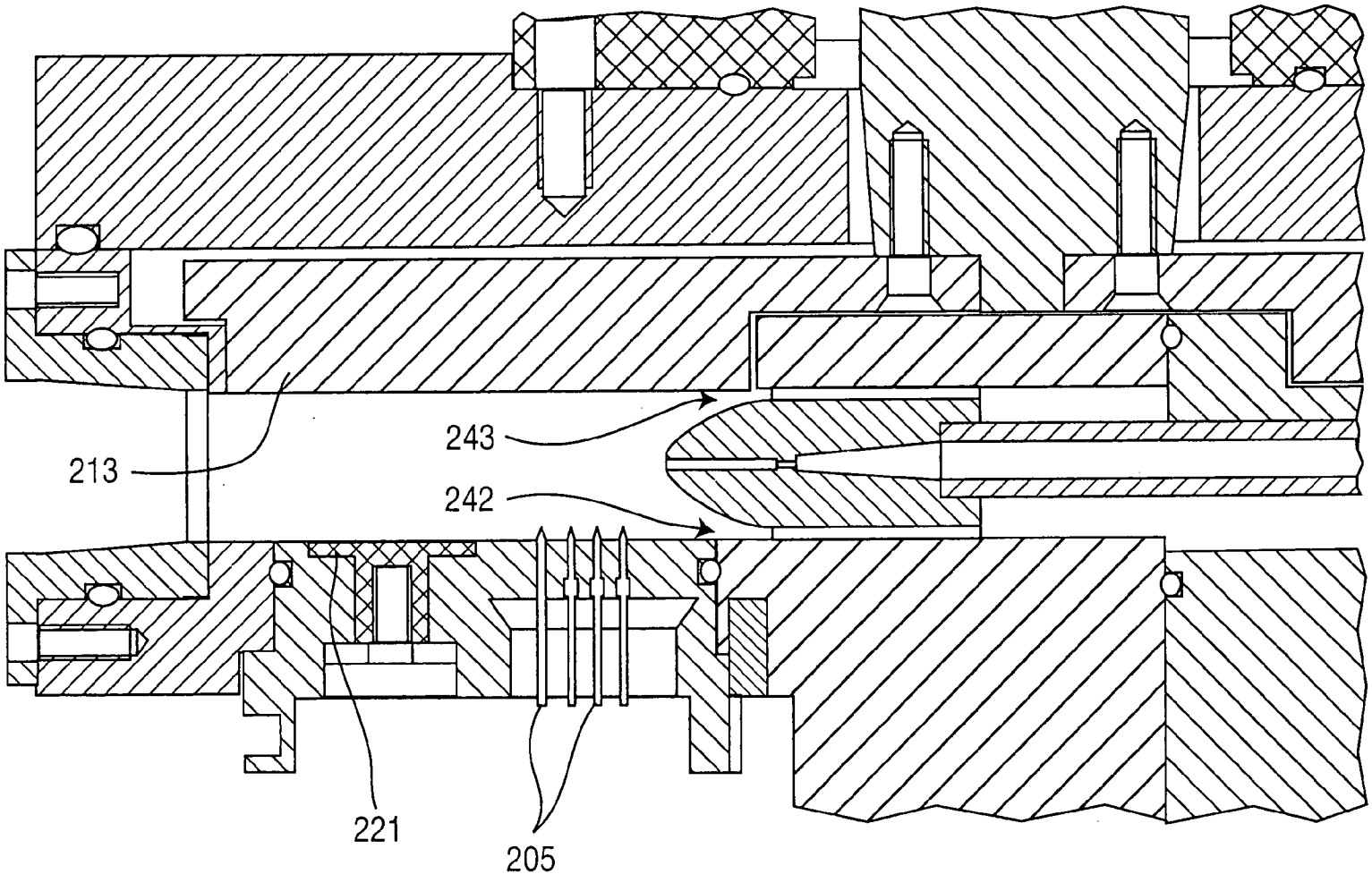
FIG. 3C shows a side cut-away view of the corona charging device focusing on a cleaning device.
FIG. 3D shows an enlarged portion of FIG. 3C.
FIG. 3E shows a view of the corona charging device looking into the powder outlet of the device.
Figure 3C:
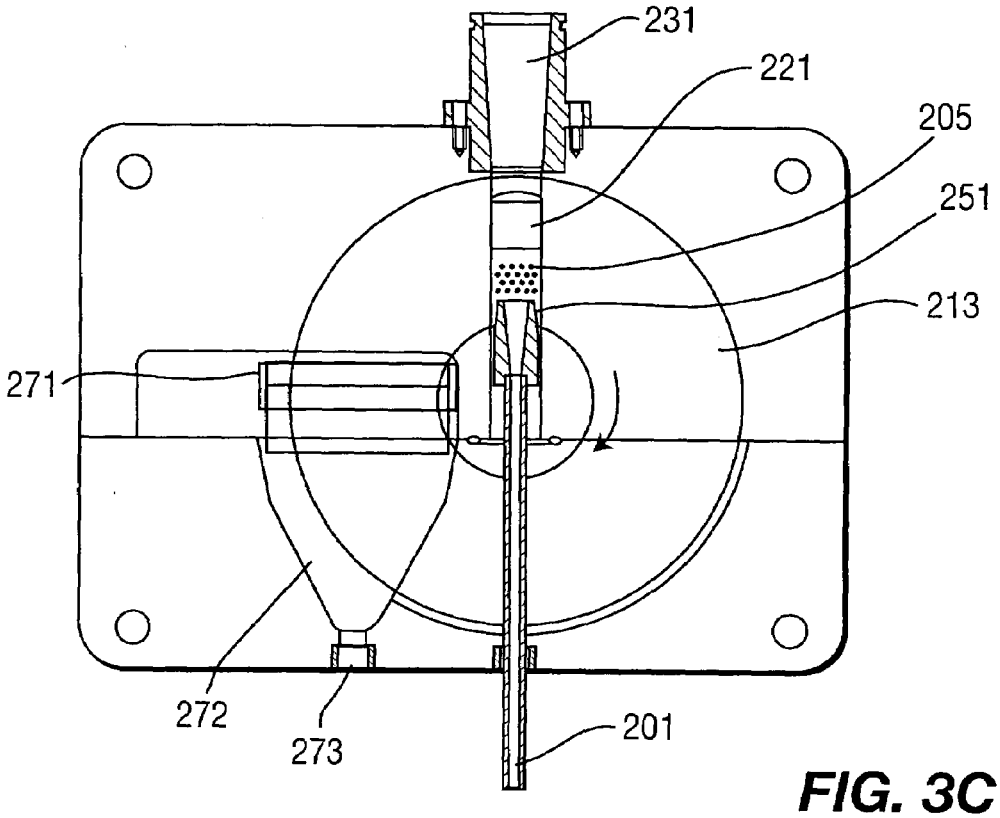
Figure 3D:
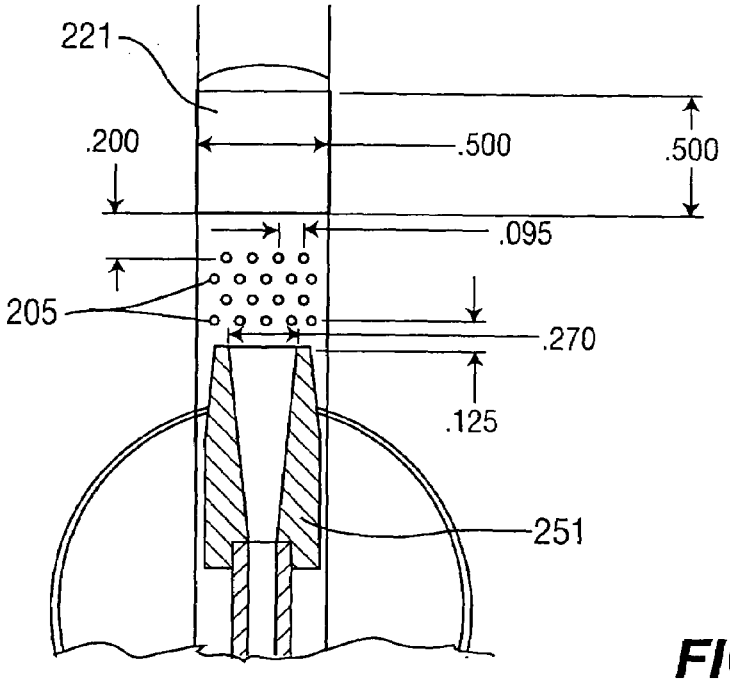
Figure 3E:
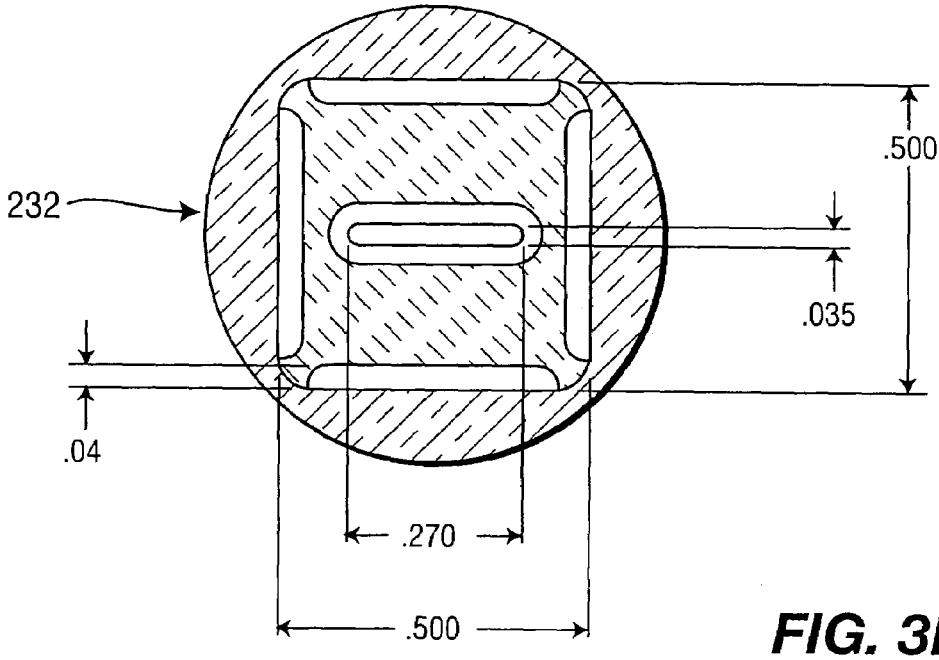

Another embodiment of the invention is illustrated FIGS. 3A–3E. This embodiment has variations of many of the features discussed above, with the reference numbers advanced by one hundred to make a two hundred series of reference numbers. Further illustrated is a nozzle fitting 251, which operates to broaden the powder stream in the plane perpendicular to the C-D axis (see FIG. 3C), while narrowing the powder stream in the plane parallel to both the C-D axis and the B-A axis. A manifold 241 for supplying gas to the sheath conduits is fed by duct 245 or similar entry. The ground electrode 213 is a disk that spins in operation as indicated by the arrow in FIG. 3C. A scraper blade 271, held by holder 271A, scrapes off powder, which is then vacuumed through reservoir 272 and vacuum port 273. A gas inlet to equalize pressure is provided through the main input 201. The residual powder may also be vacuumed away only during down times when powder and gas are not flowing, if a pressure imbalance is produced. FIG. 3E shows the view looking through nozzle 231 into charging chamber 203 at nozzle fitting 251. The figure shows nozzle outlet 253. Shading 254 shows the transition of the nozzle fitting 251 from a square outline to the oval outline of the nozzle outlet 253. Shading 232 shows the transition of the charging chamber 203 from a square outline to the oval or circular outline of the outer edges of nozzle 231

An important feature of the apparatus illustrated in FIG. 3 is the seal tightness provided by seals 261 that prevent ingress of ambient air. This design feature allows powder to be moved through the charging device by suction applied downstream, or by pressure applied from upstream.

Another important feature of the device of FIG. 3 is that the needle projections extend a uniform distance into the charging chamber, minimizing gas turbulence from needles that protrude more than the otherwise optimal distance. Also, because the ground electrode is a compact design, the length of the charging zone (after the charging area, but before the exit nozzle) is reduced. This in turn reduces the risk that charged powder will adhere to the charging zone. Other ground electrodes that can be used in this space saving design include, for example, conductive tape and conductive belts.

The powder feed geometry is adjusted to slow the powder through a more uniform portion of the corona-forming field. The inner diameter of the powder feed can be gradually changed (e.g., to an oval opening), resulting in better trajectory control of the powder through the charging zone. The charging chamber cross-section is enlarged to move walls away from charging components. The nozzle fitting constrains the flow of sheath gas to the walls only, allowing for less total gas usage for the wider charging chamber. Needle projections are staggered for a more uniform current density across the charging zone, and to reduce the aerodynamic wake effect caused by needles, thus improving needle cleanliness.

The flat disk surface of the illustrated ground electrode is parallel to the main charging chamber floor, providing better aerodynamics. The disk also allows for the charging zone to be lengthened. The disk OD was established by making the distance from the edge of the field electrode to the OD of the disk at least, for example, 10% larger than the direct distance (parallel to the corona field axis) from the field electrode to the ground electrode. This distance ensures that the electrostatic field strength is greatest between the field electrode and matching portion of the ground electrode and not the field electrode and edge of the disk, which situation could promote corona discharge. The ID of the disk was likewise determined by making the distance from the needle projections to the ID edge of the disk at least, for example, 10% larger than the minimum distance from the needle projections to the ground electrode.

The use of the simpler cleaning device has proved effective. If more than a monolayer of powder remains on the ground electrode surface, the device can go into back corona and produce ions on the wrong polarity destroying unipolar charging. The solvent based cleaning provides excellent cleaning, removing even the monolayer of powder, but the blade scraping of the current embodiment leaves only a very faint, almost indistinguishable layer of fines on the ground electrode. Tests have shown that the resulting charge-to-mass ratios and uniformity from run to run attained with scraping are very similar to those of the solvent based cleaner.

The rotating electrode (rotating ground electrode) can be, for example, a metal drum, disk or belt, a belt-like configuration of plates (analogous to a tank track) and the like. The terms "rotate" or "rotating" or formatives thereof are used herein in their broadest sense and encompass turning on an axis as well as simply proceeding in sequence. Accordingly, the rotating electrode can be formed as a movable belt, tape or web, adhesive backed or otherwise, that is reusable or disposable. The rotating electrode can be, for example, adapted to travel with a surface speed from 3 to 5 in/sec. The angle of the blade with respect to the ground electrode is, for example, 19° from the tangent point. It is understood that the angle between the blade and the ground electrode can be varied between 0° and 90° in order to maximize the cleaning efficiency without departing from the scope of the invention. A plastic or metal blade can, for example, be used. A thickness of from 0.005 to 0.015" can, for example, be used for a metal blade, and, for example, from 0.015 to 0.025" for plastic. The blade is selected from a material that is softer than the operative surface of the ground electrode. An oscillatory motion of the ground electrode can be used as needed or programmed to remove any powder debris stuck between the blade and ground electrode surface.

The design of this embodiment seals all undesirable gas leaks. The use of a disk instead of a drum makes sealing easier since the entire disk is contained with a static seal, eliminating the need for a rotary type seal around the ground electrode. An appropriate rotary seal is used around the spindle of the disk.

In this illustrative example, the ID of the powder feed is gradually changed from an approximately 0.125" opening to a 0.035"×0.270" oval opening. This design thus produces a nozzle, which fans out the powder/gas across the width of the corona needles and minimizes the thickness of the powder/gas layer with respect to the corona field axis. A thin but broad stream of powder allows for its trajectory to be confined to the more uniform electrostatic field in the center of the charging zone and away from the needle tips and the ground electrode. This trajectory control also helps keep the needle projections and ground electrode clean by directing powder away from their surfaces. It is understood that other powder feed profiles are possible without departing from the scope of the invention.

The charging chamber of this embodiment is larger in cross-section. Better performance, both with respect to efficiency and maintenance, is attained with this larger cross-section. This feature moves the walls farther away from the output of the powder feed, and allows for more sheath gas flow.

Experiments have found that the sheath gas flow should approximately match the speed of the powder/gas in the feed. Feed velocities of up to 80 m/sec or more have been useful in some designs to adequately keep the needle projections clean. For a relatively large opening, such as 0.500"×0.500" square, such flow rates require a relatively large amount of sheath gas flow, which results in higher velocities at the exit of the charging device. The charging device is typically connected to a diffuser to reduce gas/powder velocities before entry into a chamber. For some applications, such as for deposition of pharmaceutical powders, a feed having as low a velocity as possible is preferred. For uniform depositions, allow velocity is usually required, since the deposition process should be dominated by electrostatic forces, not aerodynamic forces. Other industries, such as electrostatic painting, also typically prefer low exit velocities. A boundary layer sheath gas obtained using the nozzle fitting allows the benefits of a larger charging chamber cross-section even at the relatively lower overall flow rates required for the above-discussed applications.

The boundary layer sheath gas concept is to reduce the area across which the sheath gas has to flow through to a relatively thin layer around the perimeter of the charging chamber. When the sheath gas velocity is matched to the feed velocity, a substantially lower amount of gas is required due to this reduced traversed area, but adequate wall cleaning is nonetheless provided.

In this embodiment, the needle projection pattern has been staggered, as opposed to being in a row and column matrix. Staggering the needle projections provides two benefits. First the ion current density will be more uniform across the charging zone. The staggered position of the needles will fill in the gaps compared to the old row and column needle projection matrix. The second benefit is in the aerodynamic flow past the needle projections. CFD modeling has demonstrated that the staggered position reduces the wake effect on the down stream needles. This provides for cleaner needle projections.

The distance the needle projections extend into the main flow path is, in this example, 0.040". It is understood that the extension of the needle projections can be adjusted as needed without departing from the scope of the invention. Too great a distance causes aerodynamic turbulence, too short a distance causes the to housing (e.g., polycarbonate) charge and degrades the powder charging. The distance between the needle projections and ground electrode is determined by the opening of the main powder flow path, which has been described above. An electrostatic field between 1 million to 1½ million volts per meter is, for some designs, optimal within the charging zone. At the illustrative distances described for this embodiment, this voltage would equate to about 11,700–17,500 volts at the needle projection tips. The charging zone is usually run between 50–100 uA total current as measured at the ground electrode.

The field electrode, which directs the free ions onto the ground electrode and thus produces the ion free output cloud, is spaced, in this illustrative embodiment, 0.200" away from the last row of needles and is, in this example, 0.500" long. It is understood that range of spacing is possible without departing from the scope of the invention. The distance away from the last row of needles is determined by two main factors. First the field electrode should be far enough away from the needle projection tips to avoid arc, and second the distance should be great enough so powder does not create an alternative current path. Experimentation with a device of the invention has shown that when the field electrode is run at approximately 1000 V different than the voltage of the needle projections, a leakage current into the output powder cloud of 14 pico amps can be measured. At a 1000 V difference between the electrodes, 0.200" is more then enough distance to prevent arcing. In practice, to provide a sufficient safety factor against arcing, the field strength between the field electrode and needle projections is generally kept to less than half the field strength of the needle projections to the ground electrode.

The length of the field electrode 221 along the B-A axis was determined by calculating the vector that the ions would take from the surface of the field electrode to the ground electrode, and at least doubling the distance so calculated to ensure capturing all the free ions. The mobility of ions is approximately $1.76\times10^{-4}$ $m^2/V$ sec. Using the device in accordance with FIG. 3, an ion velocity of approximately 200 m/s is obtained. With a feed velocity of 85 m/s, a minimum length of 0.213" is preferred. A length of 0.500" is more than double that length. These values will vary with the geometry of the features of a charging device, but can be calculated as described herein.

Figure 4:
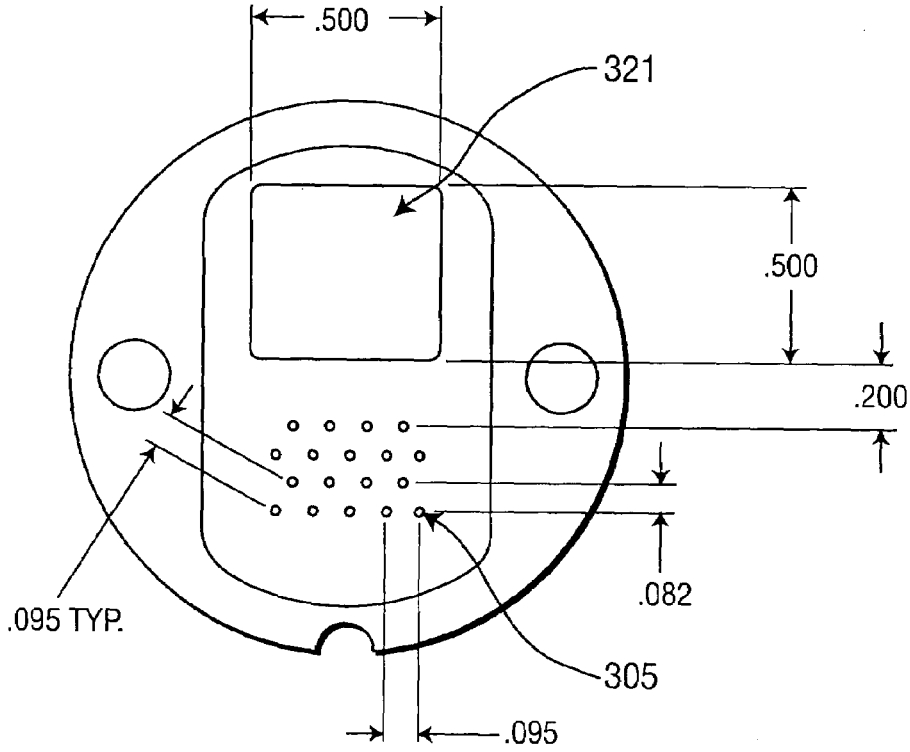
FIG. 4 shows the needle projection tips and field electrode unit of an embodiment of the invention.

FIG. 4 shows a combined device fitting having needle projections 305 and field electrode 321. This and other illustrations contain illustrative dimensions in inches.

Figure 5A:
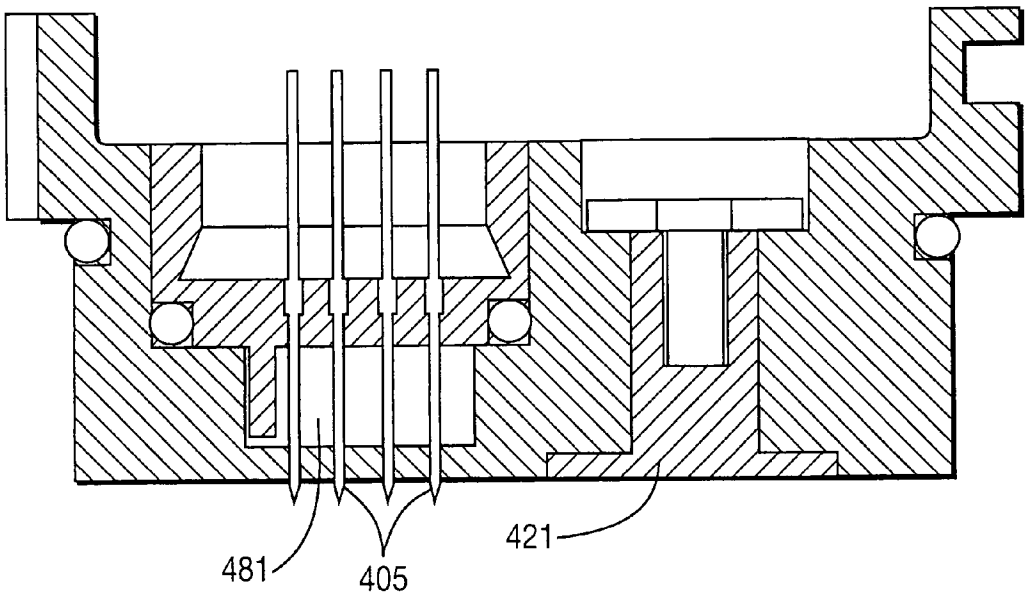
FIG. 5 focuses on a feature for cleaning the needle projection tips in an embodiment of the invention.
Figure 5B:
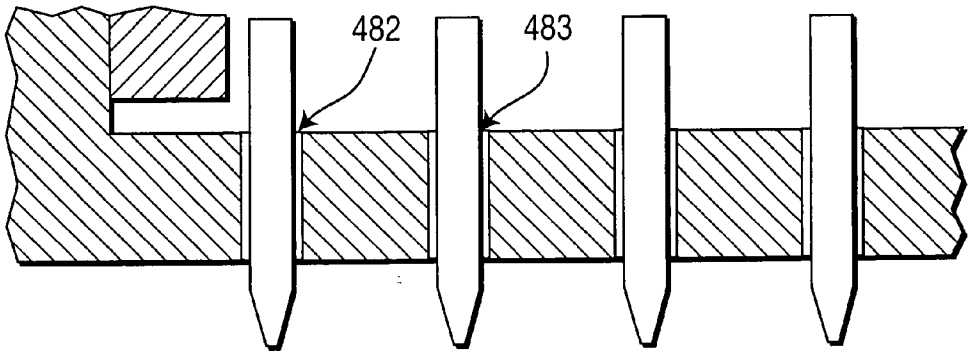

FIGS. 5A and 5B show selected portions of a corona charging device with another needle projection cleaning feature. The needle projections 405 have sheath ducts 482 connecting a sheath duct manifold 481 to the charging chamber. By using a controllable source of gas pressure to be applied to the sheath duct manifold 481, the tips of the needle projections 405 can be cleaned. Such cleaning pulses can occur regularly as programmed by a microprocessor or other controller, be operated manually as needed, or can be operated each time powder delivery is paused. The pulses are optimally used when powder charging is not in operation, but occasional use during powder charging operation should not overly disrupt charged powder delivery.

Figure 6A:
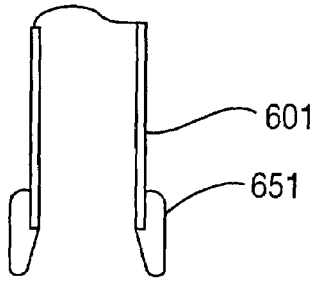
FIGS. 6A, 6B, 7A and 7B show nozzle fittings for use in a wider charging chamber.
Figure 6B:
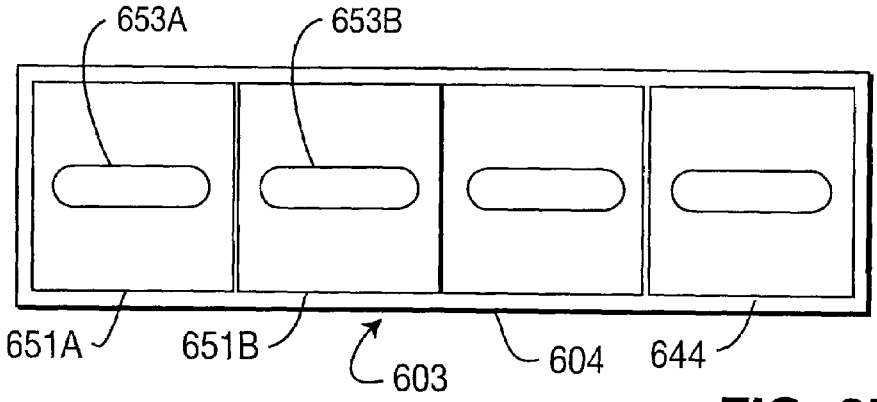
Figure 7A:
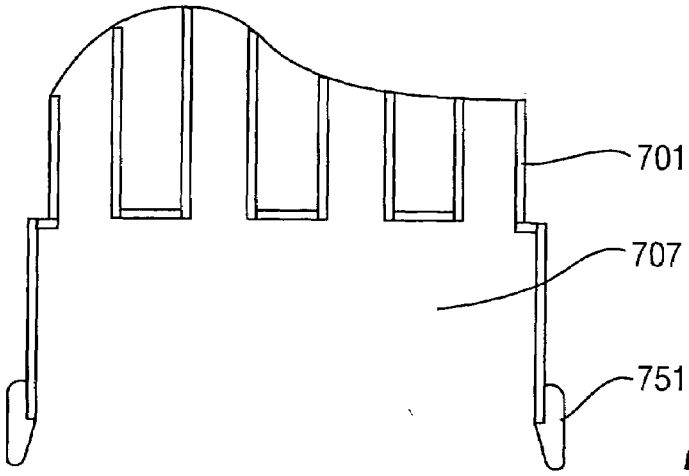
Figure 7B:
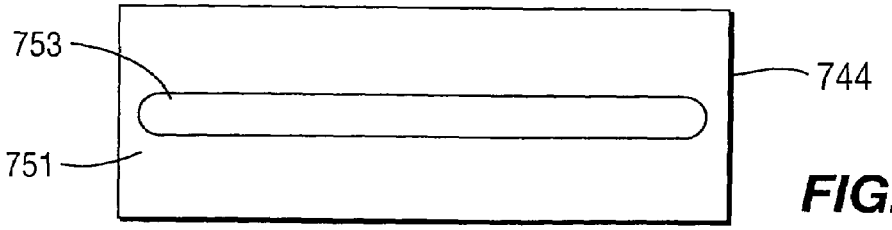

As illustrated in FIG. 6B, greater powder volume can be obtained, for example, by aligning a number of nozzle fittings 651 across a broader charging chamber 603 having walls 604. The nozzle fittings 651 present a number of nozzle outlets 653A, 653B, and so forth. The sheath conduit 644 does not need to have segments exiting between the nozzle inserts 651 since these would not operate to keep clear a surface of the charging chamber 603. FIG. 6A shows how powder conduits 601 connect to the nozzle fittings 651. Alternatively, as illustrated in FIGS. 7A and 7B, one wide nozzle fitting 751 can be fed from powder manifold 707, which can receive powder from multiple powder feeds 701 or one larger powder feed (not illustrated). Such a wider nozzle fitting 751 can also be used in a row of other nozzle fitting to make a still wider charging chamber. The widthwise scalability of the electrode features, particularly using ground electrodes like a drum, tape or belt, will be apparent to those of skill. (Tapes or belts preferably operate in the B-A direction, and are cleaned after transitioning away from the charging zone.)

The device described above has proven effective in charging diverse pharmaceutical powders. These powders are not well suited for engineering to optimize powder handling characteristics. The device is also useful with toner particles and paint particles, and would be expected to be useful with any number of powders, including powders with particles of less than micron size to a several hundred microns, and conductive or nonconductive powders. Toner particles typically have a particle size of about 7 microns, paints typically have a particle size of about 60 microns, while pharmaceuticals can have a particle size that caries over a wide range.

The above description focuses on two preferred in-process methods of cleaning the ground electrode. However, those of ordinary skill will recognize that when a currently inoperative segment of the ground electrode is moved away from the electrically active portion of the device, a great number of cleaning devices can be used. These include, but are not limited to, brushes, vacuums, gas streams and the like.

Figure 8:
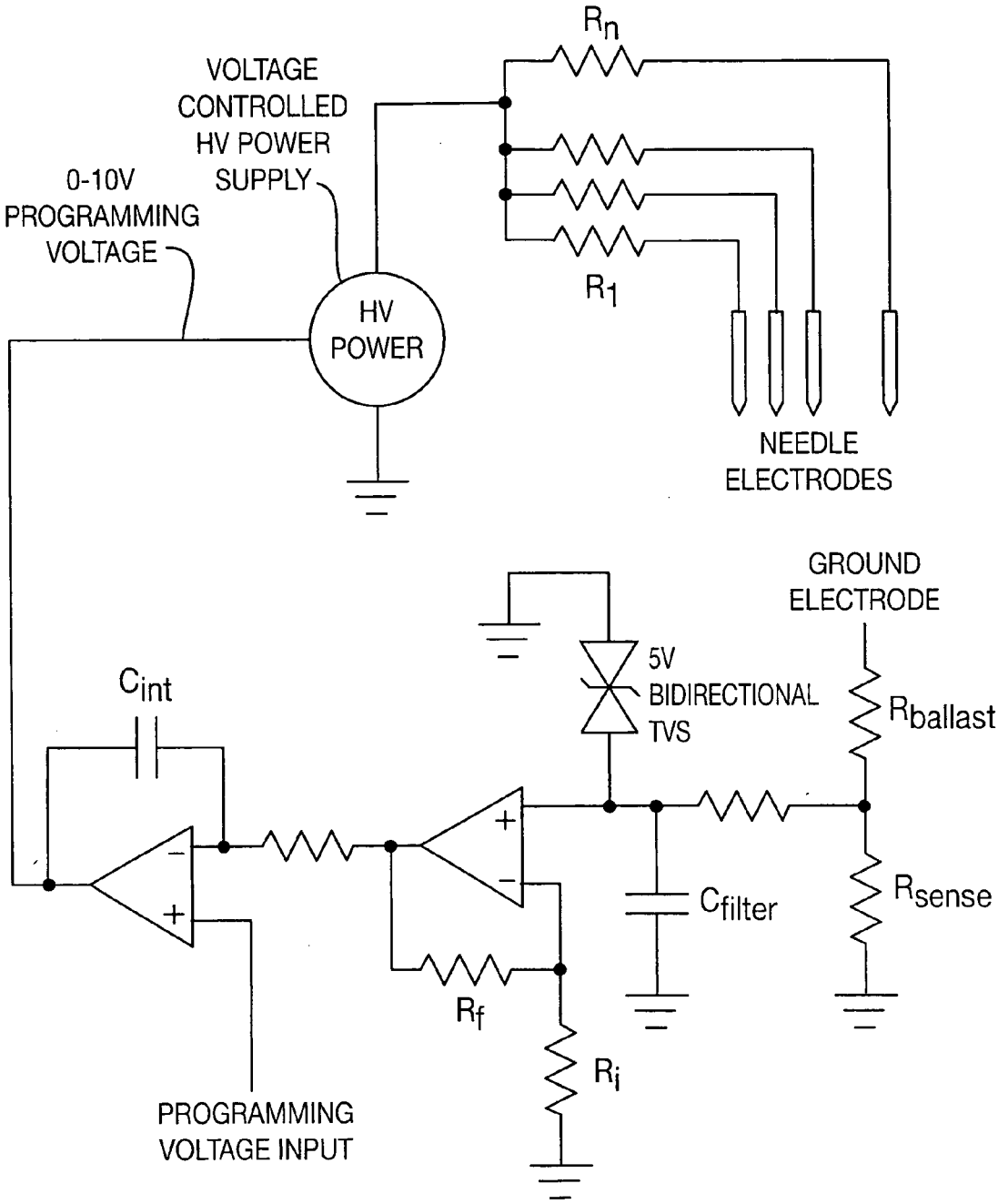
FIG. 8 shows an exemplary block diagram of a power supply and control circuitry operable to create a suitable ion current density in the charging zone.

FIG. 8 shows an exemplary block diagram of a power supply and control circuitry operable to create a suitable ion current density in the charging zone. The circuit is comprised of four major circuit elements; a voltage controlled high voltage (HV) power supply, a resistor array, variable resistor and a current control circuit.

A suitable voltage controlled high voltage (HV) power supply is commercially available from a number of power supply vendors. Typically, the programming voltage range is 0–10V. The output voltage range for the power supply used in each implementation of the invention was in the 0–20 kV range.

The resistor array as shown in FIG. 8 is labeled $R_1 \ldots R_n$. These resistors are referred to as ballast resistors and are used to limit the corona current at any of the needle tips in the charging zone. The resistor values that have been used in the charger include values ranging from 100 MΩ to 1 GΩ. In order to create a uniform current density, resistors $R_1$ . . . Rn should be relatively closely matched. This can be achieved in a variety of ways including the use of relatively high precision resistors (e.g., 1% tolerance or better) thereby creating the most uniform current density that is possible.

The third major circuit element is the charging zone. This circuit element is a variable resistor that changes resistivity with applied voltage. It is formed in the space between the needle tips, the electrode that is referred to as the ground electrode (drum, disk, etc.), and the powder stream.

The last circuit element is feedback control circuit (e.g., the two op-amp circuit shown in FIG. 8). This circuit is used to control the power supply such that the ion current collected at the ground electrode is constant. The ion current collected at the ground electrode is converted to a voltage across the resistor, $R_{sense}$. $R_{sense}$ is sometimes wired in series with an additional resistor, $R_{ballast}$. $R_{ballast}$ provides additional ballast effect to all of the needle tips simultaneously. The voltage formed across Rsense is filtered with a R-C low pass filter and then amplified by the first stage of the op-amp circuit. The output of the first stage amplifier is then input to the second amplifier stage wired as an integrating amplifier. The non-inverting input to the integrating amplifier is the voltage programming input to the control loop. This voltage sets the current through the charging zone. The integrating op-amp circuit allows the input voltage to the HV power supply to adjust to variations in the resistance of the air. Variations of the air resistance are due to parameters such as chemical variations and surface voltage variations.

It is understood that additional functionality can be added to the power supply circuitry without departing from the scope of the invention (e.g., arc monitoring function, HV limit function and the like).

Figure 9:
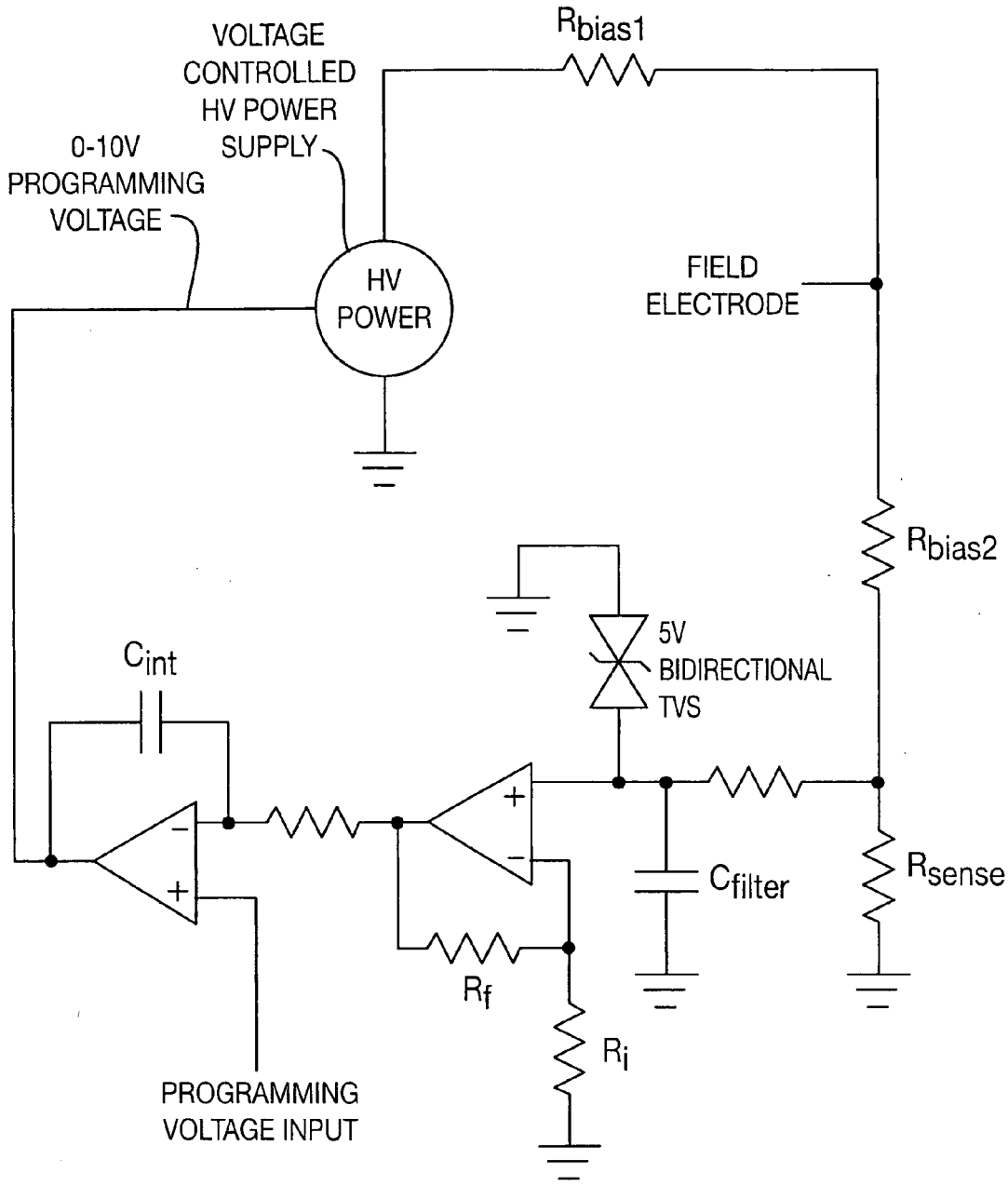
FIG. 9 shows an exemplary block diagram of a power supply and control circuitry operable to bias the field electrode.
Figure 10:
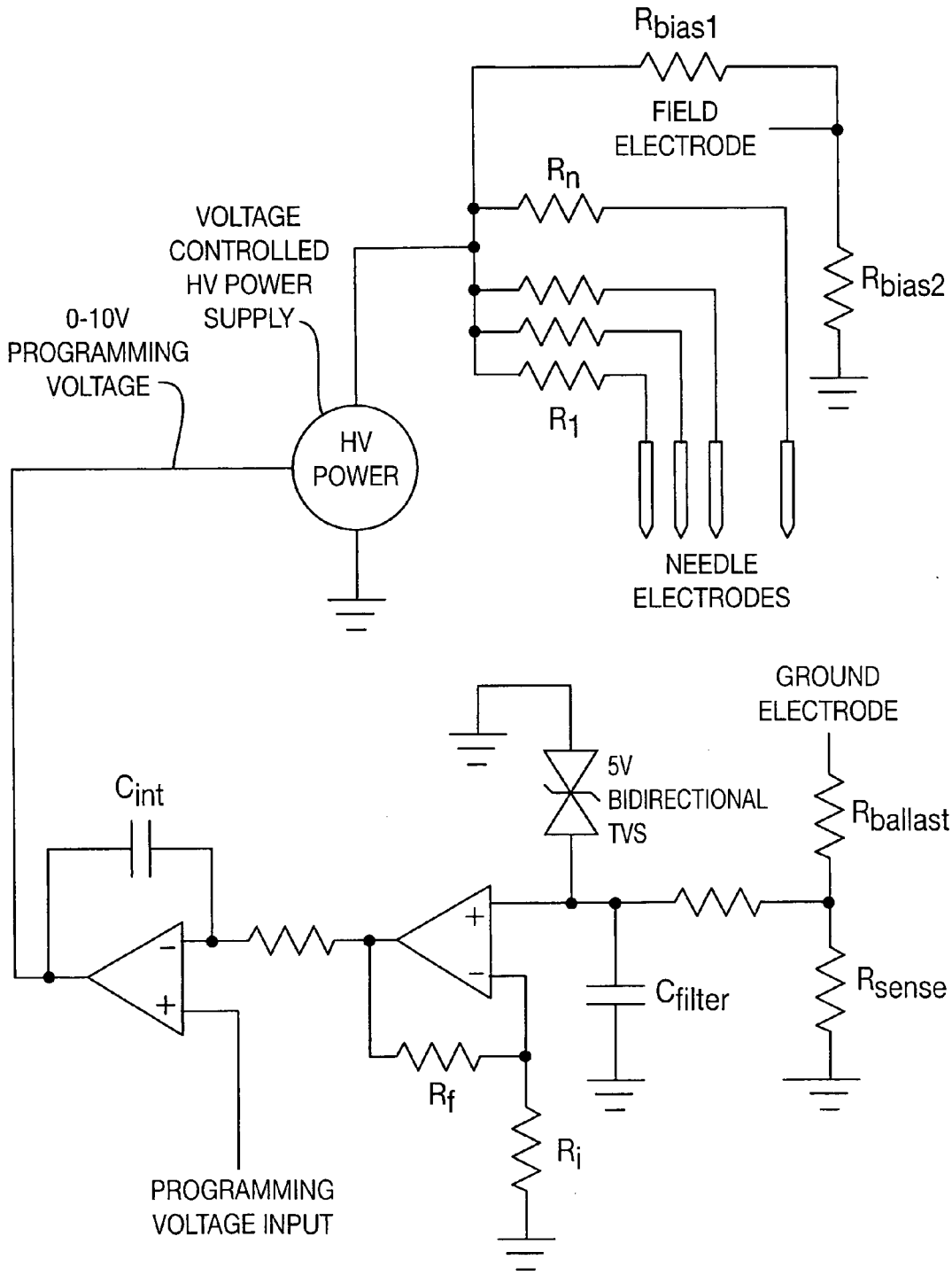
FIG. 10 shows an exemplary block diagram of an alternate power supply and control circuitry operable to bias the field electrode.

FIG. 9 shows an exemplary circuit used for biasing the field electrode. This circuit uses a duplicate control circuit and power supply. This is an optional configuration. The field electrode does not sink or source current unless there is an arc or corona event between itself and the needle electrodes. FIG. 10 shows yet another alternate configuration for biasing the field electrode. In this circuit, the electrode is biased with a resistor divider placed between the output of the HV power supply and electrical ground.

Publications and references, including but not limited to patents and patent applications, cited in this specification are herein incorporated by reference in their entirety, in the entire portion cited, as if each individual publication or reference were specifically and individually indicated to be incorporated by reference herein as being fully set forth. Any patent application to which this application claims priority is also incorporated by reference herein in the manner described above for publications and references.

While this invention has been described with an emphasis upon preferred embodiments, it will be obvious to those of ordinary skill in the art that variations in the preferred devices and methods may be used and that it is intended that the invention may be practiced otherwise than as specifically described herein. Accordingly, this invention includes all modifications encompassed within the spirit and scope of the invention as defined by the claims that follow.

What is claimed:

1. A corona charging device comprising:

a powder feed having an outlet;

an internal charging cavity having an inlet and a charged powder outlet, the powder feed outlet being positioned at the internal charging cavity inlet, the device being adapted to guide a powder stream downstream from the powder feed outlet to the charged powder outlet;

a corona charger comprising at least one needle projection, the at least one needle projection having a tip positioned and adapted to facilitate a corona ion flow from the needle projection and intersecting the powder stream, the corona charger optionally comprising a staggered array of three or more needle projections, each needle projection each having a tip positioned and adapted to facilitate a corona ion flow from the needle projection and intersecting the powder stream;

a ground electrode adapted to be charged or grounded to attract the corona flow from the needle projection, which can be a rotating ground electrode adapted to rotate segments of the ground electrode between the internal charging cavity; and one or more of:

(a) a ground electrode cleaner, wherein the ground electrode is a rotating ground electrode; or (b) a field electrode located downstream of the corona charger and positioned and adapted to induce free ions entrained in the powder stream to contact the ground electrode or a second ground electrode; or (c) one or more sheath conduits positioned around the powder feed to provide (i) a sheathing gas stream between the powder stream and the tip of the needle projection and (ii) a sheathing gas stream between the powder stream and the ground electrode, and (iii) a sheathing gas stream between the powder stream and the side walls of the charging chamber; or (d) one or more sheath conduits positioned around the powder feed to provide (i) a sheathing gas stream between the powder stream and the tip of the needle projection and (ii) a sheathing gas stream between the powder stream and the ground electrode; or (e) one or more sheath ducts positioned around portions of one or more of the needle projections from an interior part of the device to the portion of the needle projections that protrudes into the charging cavity; or (f) the combination of one or more sheath ducts positioned around portions of one or more of the needle projections from an interior part of the device to the portion of the needle projections that protrudes into the charging cavity; a manifold connected to the sheath conduit(s) and positioned for directing gas through the sheath conduit(s); and a controllable source of gas pressure connected to the manifold.

2. The corona charging device of claim 1, wherein the ground electrode comprises a rotating disk.

3. The corona charging device of one of claim 2, wherein the cleaner comprises one or more scrapers for scraping powder off the rotating ground electrode.

4. The corona charging device of one of claim 2, wherein the cleaner comprises two or more scrapers for scrapping powder off the rotating ground electrode, the scrapers positioned serially such that each successive scraper encounters a segment of rotating ground electrode cleaned by an earlier scraper.

5. The corona charging device of one of claim 1, further comprising:

a field electrode located downstream of the corona charger and positioned and adapted to induce free ion charges entrained in the powder stream to contact the ground electrode.

6. The corona charging device of claim 5, further comprising:

a controller adapted to accept a signal indicative of the amount of powder collected at a deposition site to which the corona charging device output is directed, and to use such signal to control the output of powder from the corona charging device.

7. The corona charging device of claim 1, comprising:

one or more power supply operable to produce voltage and current in the charging cavity;

a feedback control circuit monitoring the ground electrode to maintain a precise current to the one or more needles by varying the power supply voltage; and an individual ballasting resistor on each needle so that all the needles will produce corona ion flow.

8. A method of corona charging a powder comprising:

forming a corona field between the tips of one or more needle projections and a ground electrode, which can comprise forming a corona field between the tips of the one or more needle projections and a rotatable electrode having two or more segments;

passing the powder through the corona field to charge the powder and, optionally, along a further processing pathway; and conducting at least one of:

process (a) comprising: regularly rotating a segment of the ground electrode to a cleaning station while providing a new segment aligned to form the corona; and cleaning the ground electrode segments rotating through the cleaning station; or process (b) comprising: applying a second field to the powder in the processing pathway to induce free ions entrained with the powder to contact the ground electrode or a second ground electrode, the second field is effective to reduce the free ions in the powder produced by the method by 100 fold or more as compared to operating the method without the second field.

9. The method of claim 8, wherein the second field is effective (i) to reduce the free ions in the powder produced by the method 1000 fold or more as compared to operating the method without the second field or (ii), when the powder stream is applied to a deposition site, to reduce currents at the deposition site due to the free ions to 0.05% or less of currents at the deposition site due to charged powder.

10. A method of electrostatically coating a deposition site comprising: directing a charged powder to the deposition site, wherein the charged powder is contaminated with 0.05% (on a current basis) or less of charged free molecules and electrostatically attaching such directed charged powder to the deposition site.

11. A method of corona charging a powder comprising:

forming a corona field between the tips of one or more needle projections and a ground electrode;

passing the powder through the corona field to charge the powder and optionally along a further processing pathway; and conducting at least one of:

(a) concurrently passing a stream of gas having approximately the same velocity as the powder stream between the powder stream and at least one of the needle projections, the ground electrode and the chamber walls; or (b) for at least one needle projection, periodically passing a pulse of gas through a sheath around that needle projection and into the charging cavity, the pulse of gas effective to remove a portion of accumulated powder on the needle projection tip should such accumulated powder be present.

12. A method of corona charging a powder comprising:

forming a corona field in a charging zone between the tips of an array of needle projections and a ground electrode, wherein the needle projections are staggered with respect to a direction; and passing the powder in the direction and through the charging zone to charge the powder, wherein the current density in the charging zone is more uniform than it would be with a needle array of corresponding needle density arranged in row and column format with respect to the direction.

13. A method of corona charging a powder comprising:

forming a corona field between the tips of one or more needle projections and a ground electrode;

passing the powder through the corona field to charge the powder;

passing the powder through a field adapted to induce free ion charges induced by the corona field and entrained in the powder stream to contact the ground electrode or a second ground electrode to reduce the leakage current due to such free ion charges to 0.05% (on a current basis) or less than the total powder current; and measuring the q/m ratio of the charged powder by calibrating at least one sample during operation of the method.

14. The method of claim 13, wherein leakage current due to the free ion charges is 0.02% (on a current basis) or less than the total powder current.

15. The method of claim 13, wherein leakage current due to the free ion charges is 0.001% (on a current basis) or less than of the total powder current.

16. The method of claim 13, further comprising:

varying a flow rate of the powder through the corona field or the ion current density for the corona field to change the q/m ratio.

17. A method of corona charging a powder that is formed of metal, inorganic dielectrics, organic dielectrics or organic conductors, the method comprising:

forming a corona field between the tips of one or more needle projections and a ground electrode;

passing the powder through the corona field to charge the powder;

passing the powder through a field adapted to induce free ion charges induced by the corona field and entrained in the powder stream to contact the ground electrode or a second ground electrode; and achieving a charging efficiency of 95% or more.

18. The method of claim 17, wherein the charging efficiency is 98% or more.

19. The method of claim 17, wherein the charging efficiency is 99% or more.

20. The method of claim 17, wherein the resistivity of the powder is $10^2\Omega$-cm or more.

21. The corona charging device of claim 1, wherein the ground electrode is a rotating ground electrode.

22. The corona charging device of claim 21, comprising (a) a ground electrode cleaner.

23. The corona charging device of claim 1, comprising (b) a field electrode located downstream of the corona charger and positioned and adapted to induce free ions entrained in the powder stream to contact the ground electrode or a second ground electrode.

24. The corona charging device of claim 1, comprising (c) one or more sheath conduits positioned around the powder feed to provide (i) a sheathing gas stream between the powder stream and the tip of the needle projection and a sheathing gas stream between the powder stream and the ground electrode.

25. The corona charging device of claim 1, comprising (d) one or more sheath conduits positioned around the powder feed to provide (i) a sheathing gas stream between the powder stream and the tip of the needle projection and (ii) a sheathing gas stream between the powder stream and the ground electrode.

26. The corona charging device of claim 1, comprising (e) one or more sheath ducts positioned around portions of one or more of the needle projections from an interior part of the device to the portion of the needle projections that protrudes into the charging cavity.

27. The corona charging device of claim 1, comprising (f) the combination of one or more sheath ducts positioned around portions of one or more of the needle projections from an interior part of the device to the portion of the needle projections that protrudes into the charging cavity; a manifold connected to the sheath conduit(s) and positioned for directing gas through the sheath conduit(s); and a controllable source of gas pressure connected to the manifold.

28. The method of claim 8, comprising process (a).

29. The method of claim 28, wherein the cleaning is by scraping without the aid of a solvent.

30. The method of claim 28, comprising process (b).

31. The method of claim 8, comprising process (b).

32. The method of claim 11, comprising process (a).

33. The method of claim 32, comprising process (b).

34. The method of claim 11, comprising process (b).

35. The method of claim 12, wherein the array comprises 18 or more needle projections.

36. The method of claim 12, wherein the needle projections are individually electrically ballasted.

37. The corona charging device of claim 1, further comprising:

a controller adapted to accept a signal indicative of the amount of powder collected at a deposition site to which the corona charging device output is directed, and to use such signal to control the output of powder from the corona charging device.

38. The method of claim 9, wherein the second field is effective (i) to reduce the free ions in the powder produced by the method by 1000 fold or more as compared to operating the method without the second field.

39. The method of claim 9, wherein the second field is effective (ii), when the powder stream is applied to a deposition site, to reduce currents at the deposition site due to the free ions to 0.05% of currents at the deposition site due to charged powder.

40. The method of claim 39, wherein the second field is effective, when the powder stream is applied to a deposition site, to reduce currents at the deposition site due to the free ions to 0.01% of currents at the depostion site due to charged powder.

41. The method of claim 10, wherein the charged powder is contaminated with 0.01% (on a current basis) or less of charged free molecules.

* * * * *